US010665169B2

(12) United States Patent
Chang

(10) Patent No.: US 10,665,169 B2
(45) Date of Patent: May 26, 2020

(54) GATE DRIVER FOR OUTPUTTING A VARIABLE INITIALIZATION VOLTAGE AND ELECTROLUMINESCENT DISPLAY DEVICE THEREOF

(71) Applicant: LG DISPLAY CO., LTD., Seoul (KR)

(72) Inventor: SungWook Chang, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 15 days.

(21) Appl. No.: 15/974,157

(22) Filed: May 8, 2018

(65) Prior Publication Data

US 2019/0130832 A1 May 2, 2019

(30) Foreign Application Priority Data

Oct. 31, 2017 (KR) ..... 10-2017-0144264

(51) Int. Cl.
*G09G 3/3258* (2016.01)
*G09G 3/3266* (2016.01)
*G09G 3/3233* (2016.01)

(52) U.S. Cl.
CPC ..... *G09G 3/3258* (2013.01); *G09G 3/3233* (2013.01); *G09G 3/3266* (2013.01); *G09G 2300/0819* (2013.01); *G09G 2300/0842* (2013.01); *G09G 2300/0861* (2013.01); *G09G 2300/0866* (2013.01); *G09G 2310/0262* (2013.01); *G09G 2320/0219* (2013.01); *G09G 2320/0223* (2013.01); *G09G 2320/0233* (2013.01); *G09G 2320/0238* (2013.01); *G09G 2320/045* (2013.01); *G09G 2330/028* (2013.01)

(58) Field of Classification Search
CPC ..... G09G 3/3258
USPC ..... 345/691
See application file for complete search history.

(56) References Cited

U.S. PATENT DOCUMENTS

2016/0155409 A1* 6/2016 Jeoung ..... G09G 5/003 345/214
2016/0180775 A1 6/2016 Kim
2016/0322449 A1 11/2016 Pyon
2016/0351124 A1 12/2016 Kim et al.
(Continued)

FOREIGN PATENT DOCUMENTS

EP 3288016 A1 2/2018
EP 3343552 A1 7/2018

*Primary Examiner* — Long D Pham
(74) *Attorney, Agent, or Firm* — Birch, Stewart, Kolasch & Birch, LLP

(57) ABSTRACT

Provided is an electroluminescent display device. The electroluminescent display device includes a display panel including a display area in which an image is displayed and a non-display area in which an image is not displayed. The electroluminescent display device further includes a subpixel including a subpixel circuit disposed in the display area and an electroluminescent element, wherein the subpixel circuit includes a driving transistor. The electroluminescent display device also includes a gate driver disposed in the non-display area, and a variable voltage output unit disposed in the non-display area and configured to supply a variable voltage to the subpixel. The variable voltage output unit selectively outputs an initialization voltage or a reference voltage to an anode of the electroluminescent element. Therefore, the anode of the electroluminescent element can be initialized using the initialization voltage during an initialization period.

11 Claims, 10 Drawing Sheets

(56) References Cited

U.S. PATENT DOCUMENTS

| | | | | |
|---|---|---|---|---|
| 2017/0039955 | A1* | 2/2017 | Park | G09G 3/3233 |
| 2017/0061875 | A1* | 3/2017 | Cho | G09G 3/3233 |

* cited by examiner

GATE DRIVER FOR OUTPUTTING A VARIABLE INITIALIZATION VOLTAGE AND ELECTROLUMINESCENT DISPLAY DEVICE THEREOF

CROSS-REFERENCE TO RELATED APPLICATIONS

This application claims the priority of Korean Patent Application No. 10-2017-0144264 filed on Oct. 31, 2017, in the Korean Intellectual Property Office, the entire disclosure of which is fully incorporated herein by reference.

BACKGROUND

Field

The present disclosure relates to a gate driver and an electroluminescent display device, and more particularly, to a gate driver capable of expressing a black grayscale which is difficult to express as the resolution of a display device increases and to an electroluminescent display device including the same.

Description of the Related Art

Electroluminescent display devices are classified into inorganic electroluminescent display devices and organic electroluminescent display devices according to materials used for an emission layer. Among them, an organic light emitting display device includes an organic light emitting diode (OLED) that emits light by itself and has the advantages of high response speed, high luminous efficiency, high brightness, and wide viewing angle.

The OLED as a self-light emitting element includes an anode, a cathode, and an organic compound layer between the anode and the cathode. The organic compound layer includes a hole injection layer (HIL), a hole transport layer (HTL), an emission layer (EML), an electron transport layer (ETL), and an electron injection layer (EIL). When a power voltage is applied to the anode and the cathode, a hole from the HTL and an electron from the ETL move to the EML and form an exciton. The EML generates visible light by exciton.

In the organic light emitting display device, pixels each including an OLED and a transistor are disposed in a matrix form and the brightness of an image implemented on the pixels is controlled according to the grayscale of image data. Each transistor may include a driving transistor that controls the amount of current of the OLED according to data and a switching transistor that switches a current path of a pixel circuit. The driving transistor controls a driving current flowing through the OLED depending on a voltage applied between a gate and a source of the driving transistor. The amount of light emission and the brightness of the OLED are determined depending on the driving current.

All of the pixels need to have uniform pixel driving characteristics, such as a threshold voltage and electron mobility of the driving transistor, to implement a uniform image quality without a difference in brightness and color between pixels. However, there may be a difference in driving characteristics between pixels due to various reasons including process variation. And, the difference in driving characteristics between pixels may be increased due to a difference in speed of degradation between pixels over driving time of the display device. Therefore, the amount of driving current flowing through the OLED varies depending on a difference in driving characteristics between pixels, which causes the non-uniformity between pixels.

Accordingly, to improve an image quality and lifetime of an electroluminescent display device, a compensation circuit configured to compensate for a difference in driving characteristics between pixels has been applied to an organic light emitting display device. The compensation circuit may adopt internal compensation or external compensation. In the internal compensation, a voltage between a gate and a source of a driving transistor which varies depending on the electrical characteristics of the driving transistor is sampled using the compensation circuit in a pixel. Then, the sampled voltage compensates for a data voltage. In the external compensation, a voltage of a pixel which varies depending on the electrical characteristics of the driving transistors is sensed using a sensing circuit connected to the pixel. Then, pixel data (digital data) of an input image are modulated in an external compensation circuit based on the sensed voltage.

In an internal compensation circuit, the brightness of an OLED may be affected by a high-potential power voltage of a pixel. In this case, if the high-potential power voltage varies depending on a position of a pixel in a panel due to voltage drop (IR drop) of the high-potential power voltage, there may be a difference between a current of the OLED and a current required by a pixel. Thus, a uniform image quality cannot be obtained. In order to reduce the IR drop of the high-potential power voltage, the width of a high-potential power voltage line may be increased. However, in a high-resolution panel, the width of the high-potential power voltage line needs to be decreased and the length of the high-potential power voltage line is increased. Therefore, in the case of a high-resolution and large-size panel, the IR drop of the high-potential power voltage cannot be sufficiently improved by reducing a resistance of the high-potential power voltage.

Also, in a sampling operation for sampling a threshold voltage of a driving transistor, a voltage lower than an operating voltage of an OLED needs to be applied to an anode of the OLED to suppress unnecessary light emission from the OLED. As the resolution of a panel is increased, a data voltage for expressing a black grayscale is gradually decreased. Thus, a voltage applied to the anode of the OLED is gradually increased. Therefore, an effort to implement a pixel circuit capable of expressing an appropriate black grayscale is needed.

SUMMARY

An object to be achieved by the present disclosure is to provide a gate driver configured to apply a voltage to a pixel circuit in which a voltage applied to an anode of an OLED is lower than an operating voltage of the OLED and which can express a black grayscale, and to provide an electroluminescent display device including the same.

Objects of the present disclosure are not limited to the above-mentioned objects, and other objects, which are not mentioned above, can be clearly understood by those skilled in the art from the following descriptions.

According to an aspect of the present disclosure, there is provided an electroluminescent display device. The electroluminescent display device includes a display panel including a display area in which an image is displayed and a non-display area in which an image is not displayed. The electroluminescent display device further includes a subpixel including a subpixel circuit disposed in the display area and an electroluminescent element, wherein the subpixel circuit includes a driving transistor. The electroluminescent display device also includes a gate driver disposed in the non-display area, and a variable voltage output unit disposed in the non-display area and configured to supply a variable voltage to the subpixel. The variable voltage output unit selectively outputs an initialization voltage or a reference voltage to an anode of the electroluminescent element. Therefore, in the electroluminescent display device according to the present disclosure, the anode of the electroluminescent element can be initialized using the initialization voltage during an initialization period. And, in the electroluminescent display device, a decrease in the contrast ratio of the electroluminescent display device can be suppressed or minimized using the reference voltage which is a sufficiently high voltage to express a black grayscale of low brightness during a sampling period.

According to another aspect of the present disclosure, there is provided an electroluminescent display device. The electroluminescent display device includes a display panel including a display area in which an image is displayed and a non-display area in which an image is not displayed. The electroluminescent display device further includes a subpixel including a subpixel circuit disposed in the display area and an electroluminescent element, wherein the subpixel circuit includes a driving transistor and a capacitor connected to a gate of the driving transistor. The electroluminescent display device also includes a gate driver disposed in the non-display area, and a variable voltage output unit disposed in the non-display area and configured to supply a variable voltage to the subpixel. The variable voltage output unit selectively outputs a high-potential power voltage or a reference voltage to a source of the driving transistor and an electrode on one side of the capacitor. Therefore, in the electroluminescent display device according to the present disclosure, a driving current of the electroluminescent element is not affected by the high-potential power voltage. Thus, a uniform image quality can be implemented in a high-resolution panel to provide a large-size panel with improved brightness and image quality. Also, a decrease in the contrast ratio of the electroluminescent display device can be suppressed or minimized.

According to yet another aspect of the present disclosure, there is provided a gate driver configured to output a scan signal to a subpixel for displaying an image. The gate driver includes a pull-up transistor turned on or off by a voltage of a Q node and a pull-down transistor turned on or off by a voltage of a QB node. The gate driver further includes a node controller configured to control the voltages of the Q node and the QB node and a variable voltage output unit configured to selectively output any one of an initialization voltage, a high-potential power voltage, and a reference voltage depending on a driving period of the subpixel. Therefore, the number of power supply lines to be disposed in the subpixel can be reduced.

Other detailed matters of the embodiments are included in the detailed description and the drawings.

According to the present disclosure, a variable voltage which can be changed to an initialization voltage and a reference voltage depending on a driving period of a subpixel is applied to the subpixel. Therefore, an anode of an electroluminescent element can be initialized using the initialization voltage during an initialization period. And, a decrease in the contrast ratio of an electroluminescent display device can be suppressed or minimized using the reference voltage which is a sufficiently high voltage to express a black grayscale of low brightness during a sampling period.

According to the present disclosure, a gate driver for a display device includes a variable voltage output unit configured to selectively output any one of an initialization voltage, a high-potential power voltage, and a reference voltage to a variable voltage line. Therefore, the number of power supply lines to be disposed in a subpixel can be reduced.

According to the present disclosure, a driving current of an electroluminescent element for a display device is not affected by a high-potential power voltage. Therefore, a uniform image quality can be implemented in a high-resolution panel, and, thus, a large-size panel with improved brightness and image quality can be provided.

The objects to be achieved by the present disclosure, the aspects, and the effects of the present disclosure described above do not specify essential features of the claims, and, thus, the scope of the claims is not limited to the disclosure of the present disclosure.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
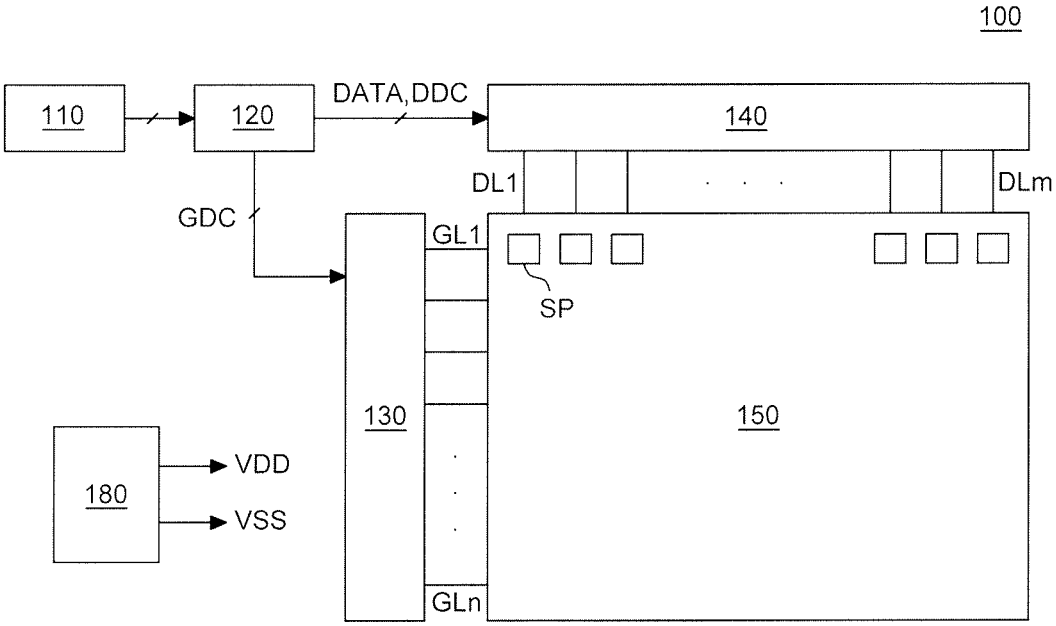
FIG. 1 is a block diagram illustrating an electroluminescent display device according to an embodiment of the present disclosure.

The advantages and characteristics of the present disclosure and a method of achieving the advantages and characteristics will be clear by referring to embodiments described below in detail together with the accompanying drawings. However, the present disclosure is not limited to embodiments disclosed herein but will be implemented in various forms. The embodiments are provided by way of example only so that a person of ordinary skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the specification. And, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When the time sequence between two or more incidents is described using the terms such as "after", "subsequent to", "next to", and "before", two or more incidents may be inconsecutive unless the terms are used with the term "immediately" or "directly".

The features of various embodiments of the present disclosure can be partially or entirely adhered to or combined with each other and can be interlocked and operated in technically various ways as understood by those skilled in the art, and the embodiments can be carried out independently of or in association with each other.

In the present disclosure, a pixel circuit and a gate driver formed on a substrate of a display panel may be implemented as n-type or p-type transistors. For example, a transistor may be implemented as having an MOSFET (Metal Oxide Semiconductor Field Effect Transistor) structure. The transistor is a three-electrode element including a gate, a source, and a drain. The source is an electrode for supplying carriers to the transistor. The carriers inside the transistor start to flow from the source. The drain is an electrode from which the carriers exit the transistor. For example, the carriers in the transistor flow from the source to the drain. In an n-type transistor, the carriers are electrons. Therefore, a source voltage is lower than a drain voltage so that electrons can flow from a source to a drain. In the n-type transistor, electrons flow from the source to the drain, and, thus, a current flows from the drain to the source. In a p-type transistor, the carriers are holes. Therefore, a source voltage is higher than a drain voltage so that holes can flow from the source to the drain. In the p-type transistor, holes flow from the source to the drain, and, thus, a current flows from the source to the drain. The source and the drain of the transistor are not fixed but may be changed depending on an applied voltage. In the following description, a drain of a transistor may be referred to a first electrode and a source of that transistor may be referred to as a second electrode.

In the following description, a gate-on voltage may be a voltage of a gate signal at which the transistor can be turned on. A gate-off voltage may be a voltage at which the transistor can be turned off. In the p-type transistor, the gate-on voltage may be a gate-low voltage (or a logic-low voltage) VL and the gate-off voltage may be a gate-high voltage (or a logic-high voltage) VH. In the n-type transistor, the gate-on voltage may be a gate-high voltage VH and the gate-off voltage may be a gate-low voltage VL.

Hereinafter, an electroluminescent display device according to embodiments of the present disclosure will be described with reference to the accompanying drawings. All components of the electroluminescent display device according to all embodiments of the present disclosure are operatively coupled and configured.

FIG. 1 is a block diagram illustrating an electroluminescent display device according to an embodiment of the present disclosure.

Referring to FIG. 1, an electroluminescent display device 100 includes an image processor 110, a timing controller 120, a gate driver 130, a data driver 140, a display panel 150, and a power supply unit 180.

The image processor 110 outputs image data supplied from the outside with driving signals for driving various devices. The driving signals output from the image processor 110 may include a data enable signal, a vertical synchronization signal, a horizontal synchronization signal, and a clock signal.

The timing controller 120 is supplied with the image data and the driving signals from the image processor 110. The timing controller 120 outputs a gate timing control signal GDC for controlling an operation timing of the gate driver 130 and a data timing control signal DDC for controlling an operation timing of the data driver 140 on the basis of the driving signals.

The gate driver 130 outputs a gate signal in response to the gate timing control signal GDC supplied from the timing controller 120. The gate driver 130 outputs the gate signal to gate lines GL1, . . . , GLn. The gate signal includes a plurality of scan signals and emission control signals. Thus, each of the gate lines may include a plurality of scan lines and emission control signal lines. The gate driver 130 may be disposed on one side of the display panel 150 in the form of an IC (integrated circuit). The gate driver 130 may be disposed through a chip on film (COF) method or disposed within the display panel 150 through a gate in panel (GIP) method. The gate driver 130 may be disposed on left and right sides or any one side of the display panel 150. The gate driver 130 includes a plurality of stages. For example, an nth stage of the gate driver 130 outputs an nth scan signal for driving an nth scan line of the display panel 150.

The data driver 140 outputs a data voltage in response to the data timing control signal DDC supplied from the timing controller 120. The data driver 140 samples and latches a digital data signal DATA supplied from the timing controller 120 to convert the data signal DATA into an analog data signal on the basis of a gamma reference voltage. The data driver 140 outputs the data signal converted into an analog form to data lines DL1, . . . , DLm. The data driver 140 may be formed on the display panel 150 in the form of an IC (integrated circuit) or may be formed on the display panel 150 through a chip on film (COF) method.

The power supply unit 180 outputs a high-potential power voltage VDD and a low-potential power voltage VSS. The high-potential power voltage VDD and the low-potential power voltage VSS output from the power supply unit 180 are supplied to the display panel 150. The high-potential power voltage VDD is supplied to the display panel 150 through a high-potential power line and the low-potential power voltage VSS is supplied to the display panel 150 through a low-potential power line. A voltage output from the power supply unit 180 may be used in the gate driver 130 or the data driver 140. The power supply unit 180 may incorporate a variable voltage output unit that selectively outputs any one of an initialization voltage, a high-potential power voltage, and a reference voltage depending on a driving period of the subpixel.

The display panel 150 displays an image in response to the gate signal and the data signal supplied from the gate driver 130 and the data driver 140, respectively, and the power supplied from the power supply unit 180. The display panel 150 includes a plurality of subpixels SPs which operate to display an image. The subpixels SPs are preferably arranged in a matrix configuration.

The display panel 150 includes a display area in which the subpixels SPs are formed and a non-display area, in which various signal lines or pads are formed, outside the display area. The display area refers to an area where an image is displayed, and, thus, the subpixels SPs are positioned. The non-display area refers to an area where an image is not displayed, and, thus, dummy subpixels are positioned or the subpixels SPs are not positioned. A variable voltage output unit may be arranged in the non-display area and may supply a variable voltage to the subpixel, wherein the variable voltage output unit selectively outputs an initialization voltage or a reference voltage to an anode of an electroluminescent element, e.g. a subpixel SP, in the display area.

The display area includes a plurality of subpixels SPs and displays an image on the basis of grayscales expressed by the subpixels SPs. The subpixels SPs are connected to data lines aligned along a column line and gate lines aligned along a pixel line (or scan line) or a row line. Subpixels SPs disposed on the same pixel line share the same gate line and operate at the same time. And, if subpixels SPs disposed on a first pixel line are defined as first subpixels and subpixels SPs disposed on an nth pixel line are defined as nth subpixels, the first subpixels to the nth subpixels operate in sequence.

The subpixels SPs in the display panel 150 are disposed in a matrix form to form a pixel array, but may not be limited thereto. The subpixels SPs may be disposed in various forms such as a pixel-sharing form, a stripe form, and a diamond form in addition to the matrix form.

The subpixels SPs may include a red subpixel, a green subpixel, and a blue subpixel, or may include a white subpixel, a red subpixel, a green subpixel, and a blue subpixel. The subpixels SPs may have one or more different emission areas depending on emission characteristics.

Figure 2:
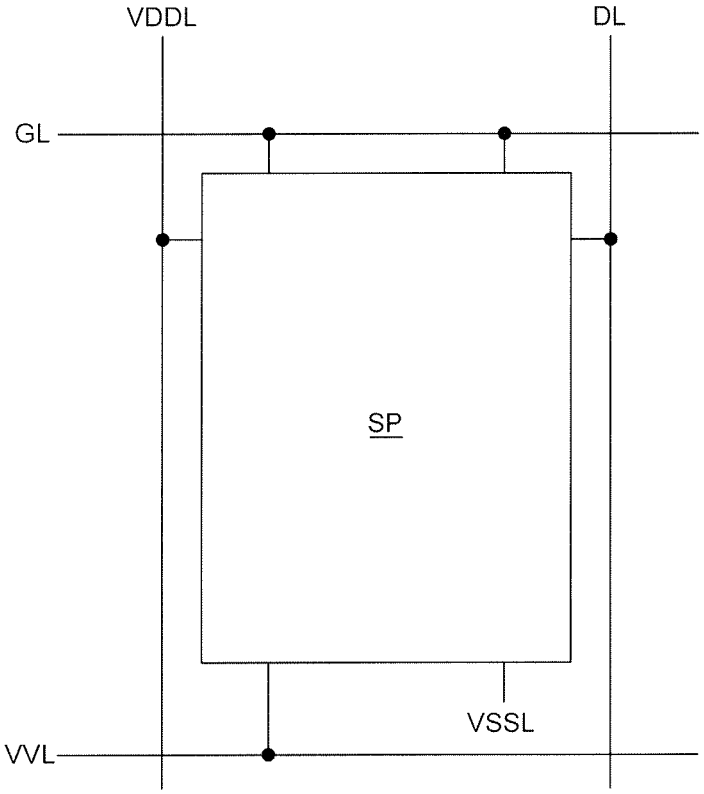
FIG. 2 is a block diagram illustrating a subpixel illustrated in FIG. 1 and a signal input into the subpixel.

FIG. 2 is a block diagram illustrating a subpixel SP illustrated in FIG. 1 and a signal input into the subpixel. Each of the subpixels SPs in FIG. 1 can have the same or similar configuration as the subpixel SP of FIG. 2 or any other subpixel SP disclosed in the figures, embodiments, and/or examples of the present disclosure.

Referring to FIG. 2, a single subpixel SP is connected to a gate line GL, a data line DL, a high-potential power voltage line VDDL, a low-potential power voltage line VSSL, and a variable voltage line VVL. In the subpixel SP, the number of transistors and capacitors, the kind of power to be input, and a driving method are determined depending on a configuration of a pixel circuit. In this case, the gate signal includes a plurality of scan signals and emission control signals. Thus, the gate line GL may include a plurality of scan lines through which a scan signal is transferred. Therefore, the gate driver of FIG. 1 may supply one or more scan signals to a single pixel circuit.

Figure 3:
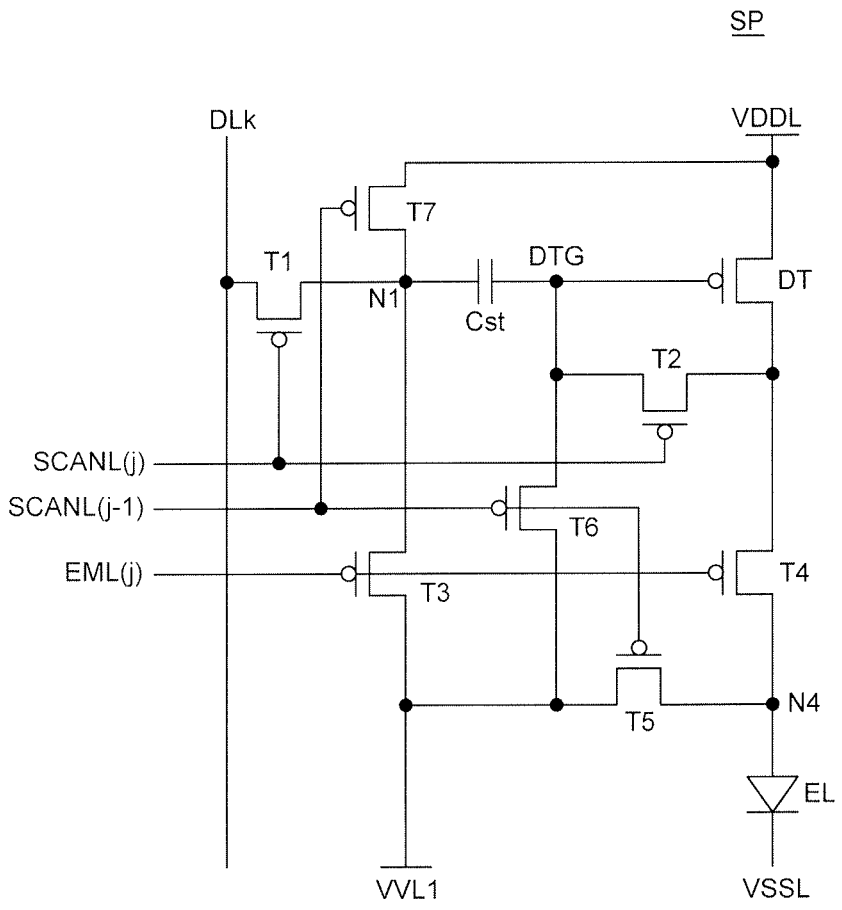
FIG. 3 is a circuit diagram of a subpixel according to a first embodiment of the present disclosure.
Figure 4:
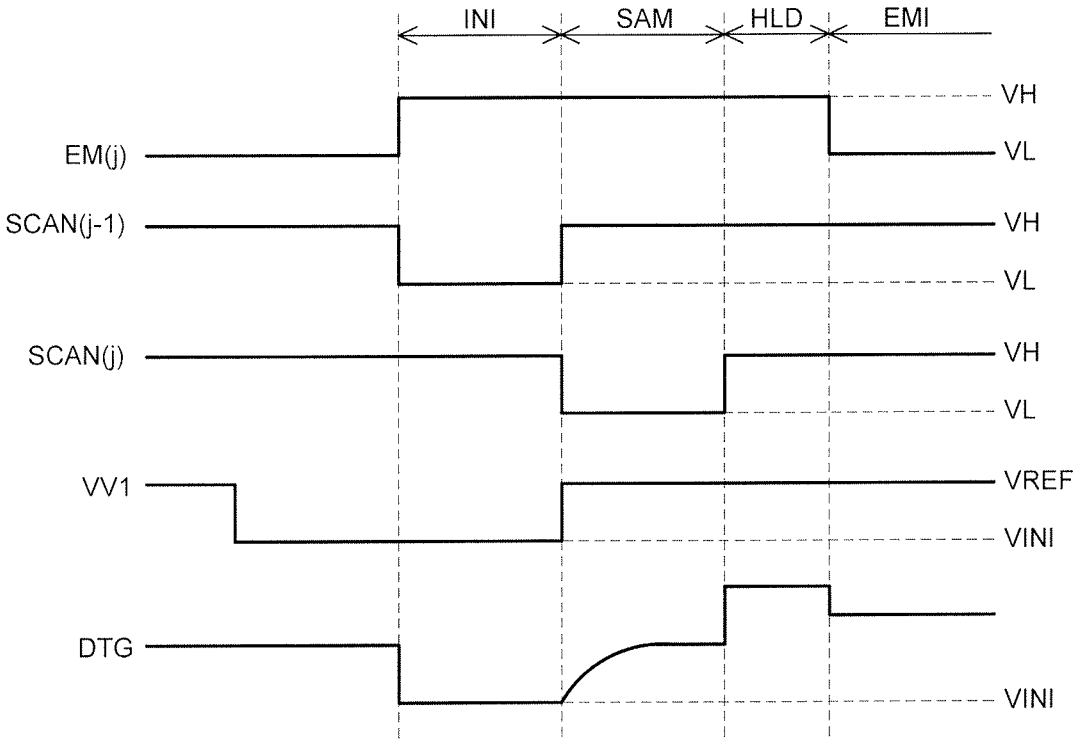
FIG. 4 is a waveform diagram provided to explain driving characteristics of a pixel circuit illustrated in FIG. 3.

FIG. 3 is a circuit diagram of a subpixel according to a first embodiment of the present disclosure. In an example, each of the subpixels of FIG. 1 can have the configuration of the subpixel of FIG. 3. FIG. 4 is a waveform diagram provided to explain driving characteristics of a pixel circuit illustrated in FIG. 3. The pixel circuit illustrated in FIG. 3 will be described with reference to a subpixel SP which is disposed on a jth pixel line of the display area and emits light with brightness corresponding to a kth data voltage. In this case, j and k are natural numbers and satisfy $1 \leq j \leq n$ and $1 \leq k \leq m$. The pixel circuit is arranged in a display area and may be driven according to the embodiment of FIG. 1.

Referring to FIG. 3 and FIG. 4, the subpixel SP includes an electroluminescent element EL, and a pixel circuit including a plurality of transistors DT and T1 to T7 and a storage capacitor Cst. Such a pixel circuit may be referred to as 8T1C circuit. In the first embodiment of the present disclosure, the transistors will be described as p-type transistors.

The pixel circuit includes an internal compensation circuit configured to compensate for a threshold voltage of the driving transistor DT. The subpixel is applied with pixel power such as the high-potential power voltage VDD, the low-potential power voltage VSS, and a variable voltage VV1. And, the subpixel is applied with a pixel driving signal such as a j−1th scan signal SCAN(j−1), a jth scan signal SCAN(j), a jth emission control signal EM(j), and a kth data voltage.

The scan signals SCAN(j−1) and SCAN(j) and the jth emission control signal EM(j) are supplied to a gate line by the gate driver 130. The gate line includes a j−1th scan line SCANL(j−1), a jth scan line SCANL(j), and a jth emission control signal line EML(j). The kth data voltage is supplied to a kth data line DLk from the data driver 140. The scan signals SCAN(j−1) and SCAN(j) swing between the logic-low voltage VL and the logic-high voltage VH with a pulse width of one horizontal period. In the first embodiment of the present disclosure, the transistors DT and T1 to T7 are p-type transistors. Therefore, the logic-low voltage VL is a gate-on voltage and the logic-high voltage VH is a gate-off voltage.

Referring to FIG. 4, the jth scan signal SCAN(j) to be synchronized with the kth data voltage subsequent to the j−1th scan signal SCAN(j−1) is supplied to the subpixel SP. A driving method of the subpixel SP may proceed from an initialization period INI to a sampling period SAM, a holding period HLD and an emission period EMI. An on-level voltage of the j−1th scan signal SCAN(j−1) is input into the subpixel SP during the initialization period INI and maintained as an off-level voltage during the other periods except the initialization period INI. An on-level voltage of the jth scan signal SCAN(j) is input into the subpixel SP during the sampling period SAM and maintained as an off-level voltage during the other periods except the sampling period SAM. An off-level voltage of the jth emission control signal EM(j) is maintained during a period including an overlap period in which both the j−1th scan signal SCAN(j−1) and the jth scan signal SCAN(j) have the on-level voltage. For example, the off-level voltage of the jth emission control signal EM(j) may correspond to three horizontal periods.

The electroluminescent element EL emits light with the amount of current controlled by the driving transistor DT depending on a data voltage and expresses the brightness corresponding to a data grayscale of an input image. As a data voltage applied to the subpixel SP illustrated in FIG. 3 is increased, a voltage between a source and a gate of the driving transistor DT is increased, and, thus, the brightness of the pixel is increased. And, as the variable voltage VV1 applied to the subpixel SP is decreased, a driving current of the driving transistor DT is increased, and, thus, the brightness of the pixel is increased. Furthermore, as the variable voltage VV1 applied to the pixel circuit is increased, the driving current is decreased, and, thus, the brightness of the pixel is decreased. As the resolution of the display panel 150 is increased, a black current for expressing a black grayscale is gradually decreased. However, the variable voltage VV1 cannot be continuously increased in order to express the black grayscale. The variable voltage VV1 is a voltage for initializing an anode of the electroluminescent element EL. Therefore, if the variable voltage VV1 is high, the electroluminescent element EL may emit light. And, there is a capacitor between the anode and a cathode of the electroluminescent element EL. Therefore, when charges in the capacitor formed between the anode and the cathode are discharged through the electroluminescent element EL, the black brightness may be increased. Accordingly, it is necessary to set the variable voltage VV1 suitable to express the brightness of a black grayscale.

Figure 10:
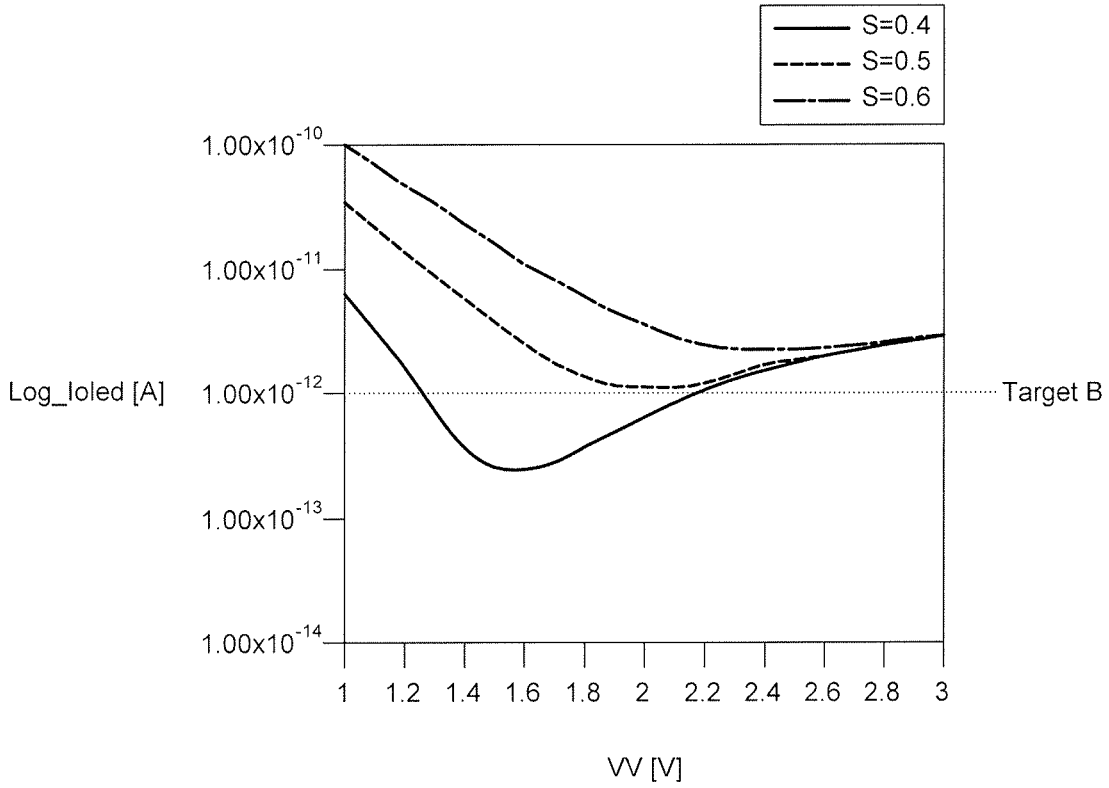
FIG. 10 is a graph showing a driving current of an OLED depending on an S-factor.

FIG. 10 is a graph showing a driving current Ioled of an OLED depending on an S-factor. The horizontal axis of the graph represents a variable voltage VV and the vertical axis represents a log value of the driving current Ioled of the OLED. FIG. 10 illustrates a graph obtained by conducting an experiment in which a signal is applied to the subpixel SP as illustrated in FIG. 3. And, the S-factor is one of values representing performances of a transistor and indicates how fast an anode of the OLED can be charged with a voltage. In this case, the S-factor represents a characteristic of a driving transistor.

With the recent improvement in performances of display panels, a value of the S-factor is increasing. As a value of the S-factor is increased, a minimum value of the driving current Ioled of the OLED is increased. For example, if a log value of a current corresponding to a target value Target B of a black grayscale is $1.00\times10^{-12}$, when the S-factor is increased, it may be impossible to set the variable voltage VV that satisfies the target value Target B of the black grayscale.

Therefore, the variable voltage VV is set not as a fixed voltage but as a changeable voltage to satisfy the target value Target B of the black grayscale. The driving method of the subpixel SP will be described in detail as follows.

Referring to FIG. 3 and FIG. 4 again, a current path of the electroluminescent element EL is turned on/off by a fourth transistor T4 which is controlled in response to an emission control signal EM(j). The electroluminescent element EL may be, for example, an OLED, and the OLED includes an organic compound layer formed between an anode and a cathode. The organic compound layer may include at least one of an EML, an HIL, an HTL, an ETL, and an EIL, but may not be limited thereto. The anode of the electroluminescent element EL is connected to a second electrode of the fourth transistor T4. The cathode of the electroluminescent element EL is connected to the low-potential power voltage line VSSL to which the low-potential power voltage VSS is applied.

The driving transistor DT is a driving element configured to control a driving current flowing through the electroluminescent element EL depending on a voltage between a source and a gate. The driving transistor DT includes a gate connected to a gate node DTG of the driving transistor, a source connected to the high-potential power voltage line VDDL to which a high-potential power voltage VDD is applied, and a drain connected to a first electrode of the fourth transistor T4.

A first transistor T1 is a switching element configured to supply the kth data voltage to a first node N1 in response to the jth scan signal SCAN(j). The jth scan signal SCAN(j) is supplied to the subpixel SP through the jth scan line SCANL (j). The kth data voltage is a voltage to be synchronized with the jth scan signal SCAN(j). The first transistor T1 includes a gate connected to the jth scan line SCANL(j), a first electrode connected to the first node N1, and a second electrode connected to the kth data line DLk.

The capacitor Cst is connected between the first node N1 and the gate node DTG of the driving transistor.

A second transistor T2 is a switching element configured to diode-connect the driving transistor DT by electrically connecting a current path between the gate and the drain of the driving transistor DT in response to the jth scan signal SCAN(j). If the driving transistor DT is diode-connected, a potential of the gate and the drain of the driving transistor DT is "VDD−|Vth|". Therefore, if the driving transistor DT is diode-connected, a threshold voltage Vth of the driving transistor DT is sampled. The second transistor T2 includes a gate connected to the jth scan line SCANL(j), a first electrode connected to the drain of the driving transistor DT, and a second electrode connected to the gate of the driving transistor DT.

A third transistor T3 is a switching element configured to supply the variable voltage VV1 to the first node N1 in response to the jth emission control signal EM(j). The jth emission control signal EM(j) is supplied to the subpixel through the jth emission control signal line EML(j). The third transistor T3 includes a gate connected to the jth emission control signal line EML(j), a first electrode connected to the first node N1, and a second electrode connected to a variable voltage line VVL1 to which the variable voltage VV1 is applied.

The fourth transistor T4 is a switching element configured to enable a driving current generated in the driving transistor DT to be applied to the anode of the electroluminescent element EL by electrically connecting a current path between the drain of the driving transistor DT and the anode of the electroluminescent element EL in response to the jth emission control signal EM(j). The fourth transistor T4 includes a gate connected to the jth emission control signal line EML(j), a first electrode connected to the drain of the driving transistor DT, and a second electrode connected to the anode of the electroluminescent element EL. The fourth transistor T4 blocks a current path between the driving transistor DT and the electroluminescent element EL during the initialization period INI, the sampling period SAM, and the holding period HLD to suppress unwanted emission of the electroluminescent element EL. If the electroluminescent element EL emits light during the other periods except the emission period EMI, the brightness of a black grayscale is increased, and, thus, the contrast ratio may be decreased. The black grayscale has the minimum grayscale value, for example, 00000000(2), in pixel data. The brightness of a pixel at the black grayscale may be the minimum brightness. And, if the image processor 110 requires a high variable voltage VV1, an anode voltage of the electroluminescent element EL may be increased during the sampling period SAM. Thus, a current may flow through the electroluminescent element EL and the electroluminescent element EL may emit light. Therefore, in order to suppress emission of the electroluminescent element EL during the other periods except the emission period EMI, the fourth transistor T4 blocks a current path connected to the electroluminescent element EL during the initialization period INI, the sampling period SAM, and the holding period HLD and connects the current path between the electroluminescent element EL and the driving transistor DT during the emission period EMI in response to the jth emission control signal EM(j).

A fifth transistor T5 is a switching element configured to supply the variable voltage VV1 to the second electrode of the fourth transistor T4 in response to the j−1th scan signal SCAN(j−1). The fifth transistor T5 includes a gate connected to the j−1th scan line SCANL(j−1), a first electrode connected to the second electrode of the fourth transistor T4, and a second electrode connected to the variable voltage line VVL1 to which the variable voltage VV1 is applied.

A sixth transistor T6 is a switching element configured to supply the variable voltage VV1 to the gate node DTG of the driving transistor in response to the j−1th scan signal SCAN (j−1). The sixth transistor T6 includes a gate connected to the j−1th scan line SCANL(j−1), a first electrode connected to the gate node DTG of the driving transistor, and a second electrode connected to the variable voltage line VVL1.

A seventh transistor T7 is a switching element configured to supply the high-potential power voltage VDD to the first node N1 in response to the j−1th scan signal SCAN(j−1). The seventh transistor T7 includes a gate connected to the j−1th scan line SCANL(j−1), a first electrode connected to the high-potential power voltage line VDDL to which the high-potential power voltage VDD is applied, and a second electrode connected to the first node N1.

In this case, the second and sixth transistors T2 and T6 connected to the gate of the driving transistor DT are turned off for a long time and thus vulnerable to a leakage current. If a leakage current occurs in the second and sixth transistors T2 and T6, a voltage of the gate node DTG of the driving transistor is changed during the emission period EMI. Thus, it is difficult to implement a desired grayscale. Therefore, the second and sixth transistors T2 and T6 may be configured to have a dual-gate structure in order to reduce a leakage current. The dual-gate structure refers to a structure in which two transistors are connected in series and controlled in response to the same gate signal. And, if the second and sixth transistors T2 and T6 are implemented as transistors, for example, oxide transistors, in which a very small leakage current occurs, they may be configured to have a single-gate structure.

Hereinafter, the driving characteristics of the subpixel SP will be described. One frame for driving the subpixel circuit illustrated in FIG. 4 includes the initialization period INI in which the j−1th scan signal SCAN(j−1) is input into the j−1th scan line SCANL(j−1), the sampling period SAM in which the jth scan signal SCAN(j) is input into the jth scan line SCANL(j), the emission period EMI in which the electroluminescent element EL emits light, and the holding period HLD between the sampling period SAM and the emission period EMI.

During the initialization period INI, a voltage of the j−1th scan signal SCAN(j−1) is reversed to a gate-on voltage and the jth emission control signal EM(j) is reversed to a gate-off voltage. During the initialization period INI, the jth scan signal SCAN(j) maintains a gate-off voltage.

As the fifth transistor T5 is turned on in response to the gate-on voltage of the j−1th scan signal SCAN(j−1) in the initialization period INI, the variable voltage VV1 is applied to the anode of the electroluminescent element EL through the fifth transistor T5.

And, as the sixth transistor T6 is turned on in response to the gate-on voltage of the j−1th scan signal SCAN(j−1), the variable voltage VV1 is applied to the gate node DTG of the driving transistor through the sixth transistor T6.

And, as the seventh transistor T7 is turned on in response to the gate-on voltage of the j−1th scan signal SCAN(j−1), the high-potential power voltage VDD is applied to the first node N1 through the seventh transistor T7.

Therefore, during the initialization period INI, the voltages of the anode of the electroluminescent element EL, the gate node DTG of the driving transistor, and the first node N1 are initialized using the variable voltage VV1 and the high-potential power voltage VDD, respectively. And, during the initialization period INI, the first to fourth transistors T1 to T4 and the driving transistor DT except the fifth transistor T5, the sixth transistor T6, and the seventh transistor T7 are turned off. In this case, the variable voltage VV1 is an initialization voltage VINI for initializing the gate node DTG of the driving transistor. The initialization voltage VINI is higher than the logic-low voltage VL. For example, the initialization voltage VINI is −3 V and the logic-low voltage VL is −7 V.

During the sampling period SAM, the voltage of the j−1th scan signal SCAN(j−1) is reversed to a gate-off voltage and a voltage of the jth scan signal SCAN(j) is reversed to a gate-on voltage. During the sampling period SAM, the jth emission control signal EM(j) maintains the gate-off voltage.

As the first transistor T1 is turned on in response to the gate-on voltage of the jth scan signal SCAN(j) in the sampling period SAM, the data voltage is applied to the first node N1 through the first transistor T1. Since the first node N1 is applied with the data voltage, a potential of the first node N1 is changed from the high-potential power voltage VDD to the data voltage. In this case, the data voltage may be denoted as Vdata. The data voltage is applied to an electrode on one side of the capacitor Cst through the first node N1.

And, as the second transistor T2 is turned on in response to the gate-on voltage of the jth scan signal SCAN(j), the driving transistor DT is diode-connected. If the driving transistor DT is diode-connected, a potential of the gate and the drain of the driving transistor DT is "VDD−|Vth|" due to a current flowing through the driving transistor DT. In this case, if the driving transistor DT is diode-connected, the threshold voltage Vth of the driving transistor DT is sampled and then applied to an electrode on the other side of the capacitor Cst through the gate node DTG of the driving transistor.

During the sampling period SAM, the third to seventh transistors T3 to T7, except the first transistor T1 and the second transistor T2, are turned off.

During the holding period HLD, the voltage of the jth scan signal SCAN(j) is reversed to a gate-off voltage. During the holding period HLD, the j−1th scan signal SCAN(j−1) and the jth emission control signal EM(j) maintain the gate-off voltage.

The voltages of the first node N1 and the gate node DTG of the driving transistor may be changed as much as a kickback voltage Vkb generated when the jth scan signal SCAN(j) is changed to the gate-off voltage in the holding period HLD. Therefore, during the holding period HLD, the voltage of the first node N1 is "Vdata+Vkb" and the voltage of the gate node DTG of the driving transistor is "VDD−|Vth|+Vkb". The changed voltages of the first node N1 and the gate node DTG of the driving transistor are applied to the capacitor Cst. And, during the holding period HLD, the driving transistor DT is also turned off due to an increase in voltage of the gate node DTG of the driving transistor. And, the third to seventh transistors T3 to T7 maintain the turn-off state.

During the emission period EMI, the voltage of the jth emission control signal EM(j) is reversed to a gate-on voltage. During the emission period EMI, the j−1th scan signal SCAN(j−1) and the jth scan signal SCAN(j) maintain the gate-off voltage.

As the third transistor T3 is turned on in response to the gate-on voltage of the jth emission control signal EM(j) in the emission period EMI, the variable voltage VV1 is applied to the first node N1 through the third transistor T3. Therefore, the voltage of the first node N1 is changed from "Vdata+Vkb" to the variable voltage VV1. In this case, the variable voltage VV1 is a reference voltage VREF. The reference voltage VREF is higher than the initialization voltage VINI.

And, the voltage of the gate node DTG of the driving transistor is changed as much as a voltage variation Vdata+Vkb−VREF of the first node N1 due to a coupling through the capacitor Cst. For example, the voltage of the gate node DTG of the driving transistor is changed from "VDD−|Vth|+Vkb" to "{VDD−|Vth|+Vkb}−{Vdata+Vkb−VREF}", that is, "VDD−|Vth|−Vdata+VREF". In this case, the source of the driving transistor DT maintains the high-potential power voltage VDD. Accordingly, a voltage Vsg between the source and the gate of the driving transistor DT that determines a driving current of the electroluminescent element EL is set. A driving current Ie1 as represented by the following Equation 1 flows through the electroluminescent element EL.

$$Ie1=K(Vsg-|Vth|)^2=K\{\mathrm{VDD}-[\mathrm{VDD}-|Vth|-V\mathrm{data}+V\mathrm{REF}]-|Vth|\}^2=K(V\mathrm{data}-V\mathrm{REF})^2 \quad \text{[Equation 1]}$$

Herein, K represents a constant value which is determined by the mobility, channel ratio and parasitic capacitance of the driving transistor DT and Vth represents a threshold voltage of the driving transistor DT.

As can be seen from Equation 1, a current of the electroluminescent element EL of the present disclosure is not affected by the high-potential power voltage VDD. In the embodiments of the present disclosure, the driving current Ie1 of the electroluminescent element EL is not affected by the high-potential power voltage VDD. Thus, a uniform image quality can be implemented in a high-resolution panel and a large-size panel with improved brightness and image quality can be provided.

And, the variable voltage VV1 which can be changed to any one of the initialization voltage VINI and the reference voltage VREF depending on a driving period is applied to the subpixel SP. Thus, the anode of the electroluminescent element EL can be initialized using the initialization voltage VINI during the initialization period INI. And, a decrease in contrast ratio of the electroluminescent display device can be suppressed using the reference voltage VREF which is a sufficiently high voltage to express a black grayscale of low brightness during the sampling period SAM.

Hereinafter, a configuration of the gate driver configured to apply the variable voltage VV1 which can be changed to the initialization voltage VINI and the reference voltage VREF to the subpixel SP will be described.

Figure 5:
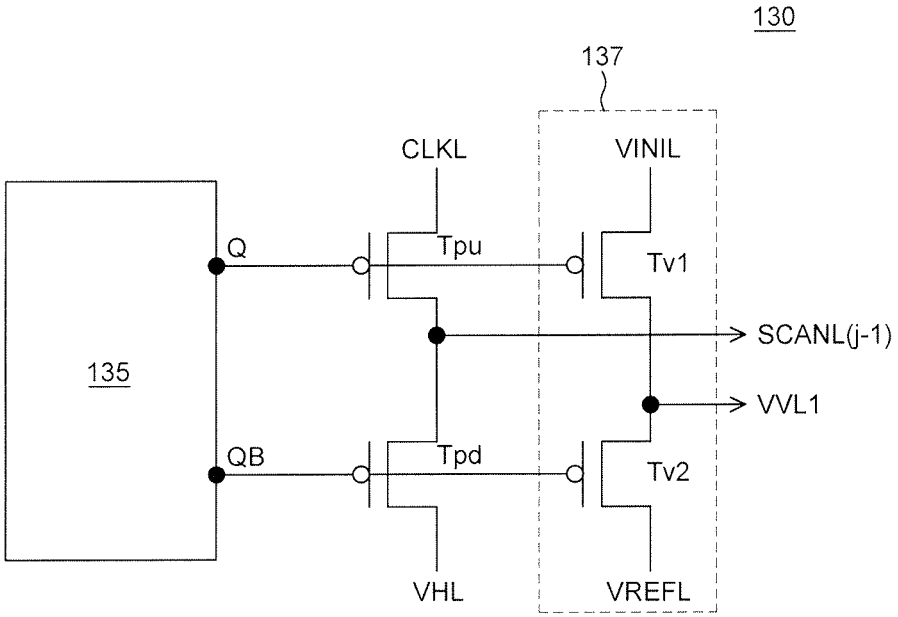
FIG. 5 is a diagram illustrating a configuration of a gate driver according to the first embodiment of the present disclosure.

FIG. 5 is a diagram illustrating a configuration of a gate driver according to the first embodiment of the present disclosure.

The gate driver 130 includes a pull-up transistor Tpu whose gate is connected to a Q node Q, a pull-down transistor Tpd whose gate is connected to a QB node QB, a node controller 135 configured to control voltages of the Q node Q and the QB node QB, and a variable voltage output unit 137.

The node controller 135 may include transistors configured to charge or discharge the Q node Q and the QB node QB with voltages having phases opposite to each other.

The Q node Q and the QB node QB are charged or discharged opposite to each other. For example, if the logic-high voltage VH is applied to the Q node Q, the logic-low voltage VL is applied to the QB node QB. If the logic-low voltage VL is applied to the Q node Q, the logic-high voltage VH is applied to the QB node QB. In this case, the pull-up transistor Tpu and the pull-down transistor Tpd are turned on/turned off, and, thus, the gate-on voltage or the gate-off voltage can be supplied to the subpixel SP.

A gate of the pull-up transistor Tpu is connected to the Q node Q, a first electrode is connected to a clock signal line CLKL to which a clock signal is applied, and a second electrode is connected to the j−1th scan line SCANL(j−1) to which the j−1th scan signal SCAN(j−1) is output. When the logic-low voltage VL is applied to the Q node Q, the pull-up transistor Tpu is turned on and outputs a clock signal to the j−1th scan line SCANL(j−1). For example, the clock signal swings between the logic-low voltage VL and the logic-high voltage VH with a pulse width of one horizontal period. And, when the Q node Q has the logic-low voltage VL, the clock signal may be the logic-low voltage VL.

A gate of the pull-down transistor Tpd is connected to the QB node QB, a first electrode is connected to the j−1th scan line SCANL(j−1) to which the j−1th scan signal SCAN(j−1) is output, and a second electrode is connected to a logic-high voltage line VHL to which the logic-high voltage VH is applied. When the logic-low voltage VL is applied to the QB node QB, the pull-down transistor Tpd is turned on and outputs the logic-high voltage VH to the j−1th scan line SCANL(j−1).

The variable voltage output unit 137 according to the first embodiment of the present disclosure includes a first variable voltage transistor Tv1 and a second variable voltage transistor Tv2 to output the variable voltage VV1.

A gate of the first variable voltage transistor Tv1 is turned on or off as connected to the Q node Q and synchronized with the pull-up transistor Tpu. A first electrode of the first variable voltage transistor Tv1 is connected to an initialization voltage line VINIL to which the initialization voltage VINI is applied, and a second electrode is connected to the variable voltage line VVL1 to which the variable voltage VV1 is output. When the logic-low voltage VL is applied to the Q node Q, the first variable voltage transistor Tv1 is turned on and outputs the initialization voltage VINI to the variable voltage line VVL1.

A gate of the second variable voltage transistor Tv2 is turned on or off as connected to the QB node QB and synchronized with the pull-down transistor Tpd. A first electrode of the second variable voltage transistor Tv2 is connected to the variable voltage line VVL1 to which the variable voltage VV1 is output, and a second electrode is connected to a reference voltage line VREFL to which the reference voltage VREF is applied. When the logic-low voltage VL is applied to the QB node QB, the second variable voltage transistor Tv2 is turned on and outputs the reference voltage VREF to the variable voltage line VVL1.

The gate driver according to the first embodiment of the present disclosure includes the variable voltage output unit 137 which can selectively output the initialization voltage VINI and the reference voltage VREF to the variable voltage line VVL1. Thus, the number of power supply lines to be disposed in the subpixel SP can be reduced.

Figure 6:
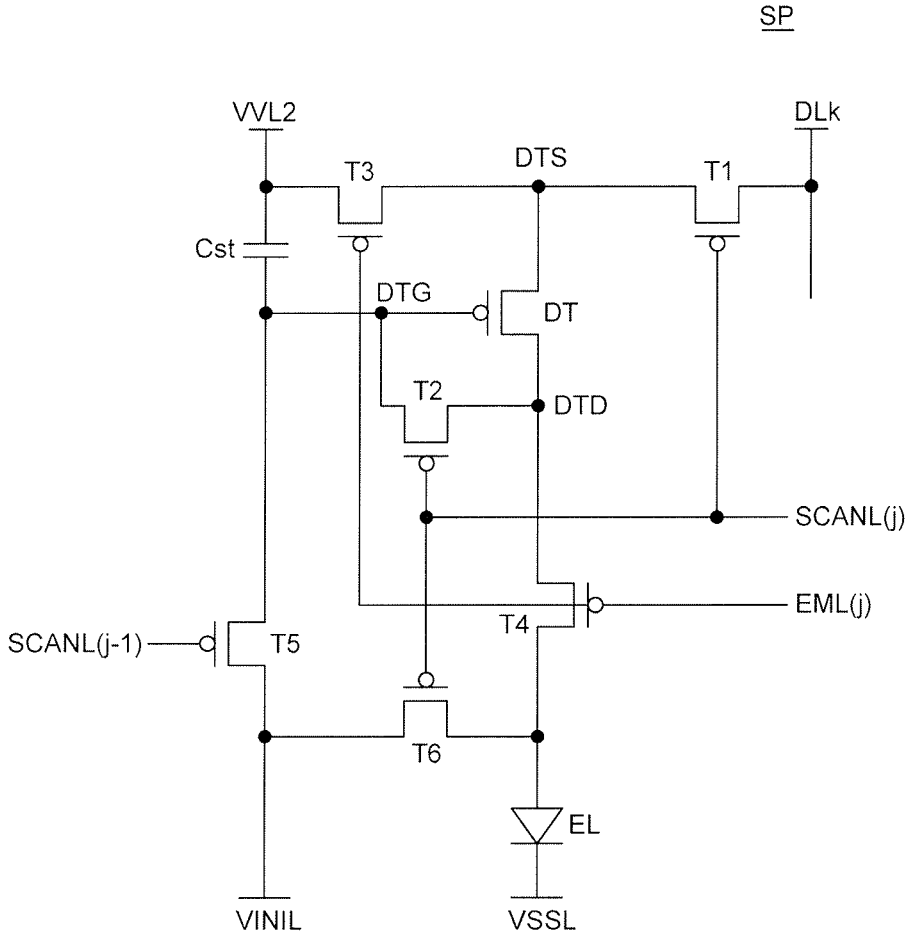
FIG. 6 is a circuit diagram of a subpixel according to a second embodiment of the present disclosure.
Figure 7:
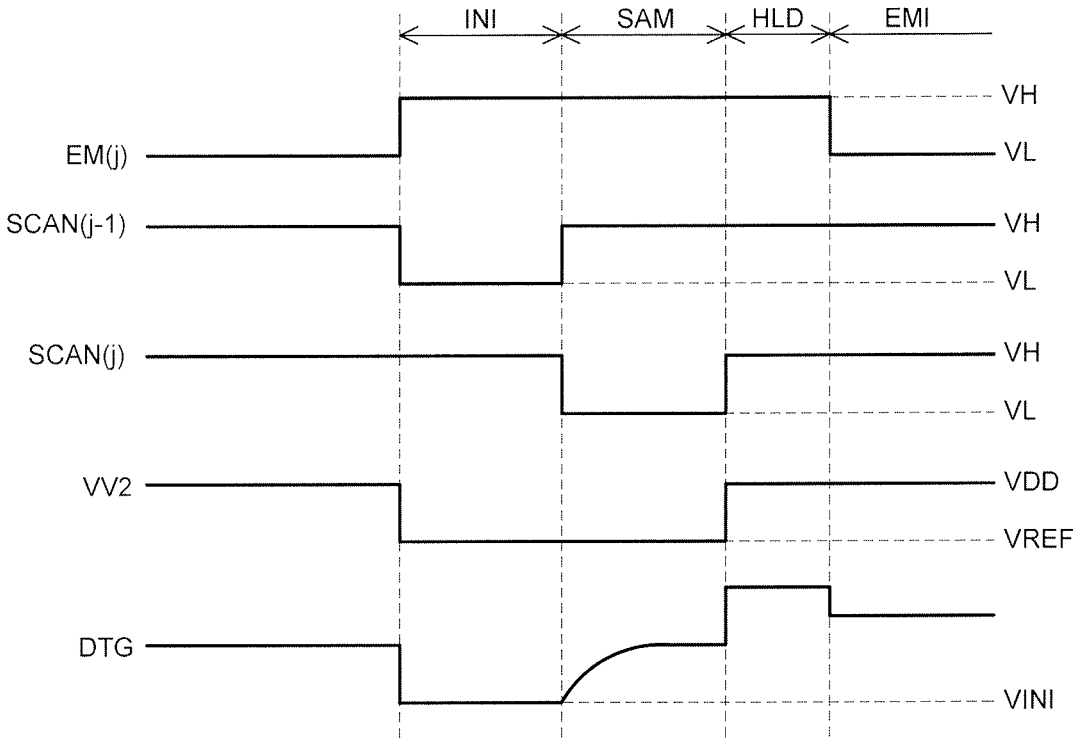
FIG. 7 is a waveform diagram provided to explain driving characteristics of a pixel circuit illustrated in FIG. 6.

FIG. 6 is a circuit diagram of a subpixel according to a second embodiment of the present disclosure. Each subpixel in FIG. 1 can have the configuration of the subpixel in FIG. 6. FIG. 7 is a waveform diagram provided to explain driving characteristics of a pixel circuit illustrated in FIG. 6. The pixel circuit illustrated in FIG. 6 will be described with reference to a subpixel SP which is disposed on a jth pixel line of the display area and emits light with brightness corresponding to a kth data voltage. In this case, j and k are natural numbers and satisfy $1 \le j \le n$ and $1 \le k \le m$.

Referring to FIG. 6 and FIG. 7, the subpixel SP includes an electroluminescent element EL, and a pixel circuit including a plurality of transistors DT and T1 to T6 and a storage capacitor Cst. Such a pixel circuit may be referred to as 7T1C circuit. In the second embodiment of the present disclosure, the transistors will be described as p-type transistors.

The pixel circuit includes an internal compensation circuit configured to compensate for a threshold voltage of the driving transistor DT. The subpixel SP is applied with pixel power such as the initialization voltage VINI, the low-potential power voltage VSS, and the variable voltage VV2. And, the subpixel SP is applied with a pixel driving signal such as the j−1th scan signal SCAN(j−1), the jth scan signal SCAN(j), the jth emission control signal EM(j), and the kth data voltage.

The scan signals SCAN(j−1) and SCAN(j) and the jth emission control signal EM(j) are supplied to gate lines by the gate driver 130. The gate line includes the j−1th scan line SCANL(j−1), the jth scan line SCANL(j), and the jth emission control signal line EML(j). The kth data voltage is supplied to the kth data line DLk from the data driver 140. The scan signals SCAN(j−1) and SCAN(j) swing between the logic-low voltage VL and the logic-high voltage VH with a pulse width of one horizontal period. In the second embodiment of the present disclosure, the transistors DT and T1 to T6 are p-type transistors. Therefore, the logic-low voltage VL is a gate-on voltage and the logic-high voltage VH is a gate-off voltage.

Referring to FIG. 6, the jth scan signal SCAN(j) to be synchronized with the kth data voltage subsequent to the j−1th scan signal SCAN(j−1) is supplied to the subpixel SP. A driving method of the subpixel SP may proceed from the initialization period INI to the sampling period SAM, the holding period HLD and the emission period EMI. An on-level voltage of the j−1th scan signal SCAN(j−1) is input into the subpixel SP during the initialization period INI and maintained as an off-level voltage during the other periods except the initialization period INI. An on-level voltage of the jth scan signal SCAN(j) is input into the subpixel SP during the sampling period SAM and maintained as an off-level voltage during the other periods except the sampling period SAM. An off-level voltage of the jth emission control signal EM(j) is maintained during a period including an overlap period between the j−1th scan signal SCAN(j−1) and the jth scan signal SCAN(j). For example, the off-level voltage of the jth emission control signal EM(j) may correspond to three horizontal periods.

The electroluminescent element EL emits light with the amount of current controlled by the driving transistor DT depending on a data voltage and expresses the brightness corresponding to a data grayscale of an input image. As a data voltage applied to the subpixel SP illustrated in FIG. 6 is increased, a voltage between the source and the gate of the driving transistor DT is increased, and, thus, the brightness of the pixel is increased. And, as the reference voltage applied to the subpixel SP is decreased, the driving current Ie1 of the driving transistor DT is increased, and, thus, the brightness of the pixel is increased. And, as the reference voltage applied to the pixel circuit is increased, the driving current Ie1 is decreased, and, thus, the brightness of the pixel is decreased. As the resolution of the display panel 150 is increased, a black current for expressing a black grayscale is gradually decreased. However, the reference voltage cannot be continuously increased in order to express the black grayscale. If the reference voltage is high, the electroluminescent element EL may emit light. To solve or address this limitation, in the first embodiment of the present disclosure, the variable voltage VV1 which can be changed to the initialization voltage VINI and the reference voltage VREF is applied as a voltage for initializing the anode of the electroluminescent element EL. In the second embodiment of the present disclosure, the initialization voltage VINI is used as a voltage for initializing the anode of the electroluminescent element EL and a variable voltage VV2 which can be changed to the high-potential power voltage VDD and the reference voltage VREF is applied.

Referring to FIG. 6 and FIG. 7, a current path of the electroluminescent element EL is turned on/off by the fourth transistor T4 which is controlled in response to the emission control signal EM(j). The electroluminescent element EL may be, for example, an OLED, and the OLED includes an organic compound layer formed between an anode and a cathode. The organic compound layer may include at least one of an EML, an HIL, an HTL, an ETL, and an EIL, but may not be limited thereto. The anode of the electroluminescent element EL is connected to the second electrode of the fourth transistor T4. The cathode of the electroluminescent element EL is connected to the low-potential power voltage line VSSL to which the low-potential power voltage VSS is applied.

The driving transistor DT is a driving element configured to control a driving current flowing through the electroluminescent element EL depending on a voltage between a source and a gate. The driving transistor DT includes a gate connected to the gate node DTG of the driving transistor, a source connected to a source node DTS of the driving transistor, and a drain connected to a drain node DTD of the driving transistor.

The first transistor T1 is a switching element configured to supply the kth data voltage to the source node DTS of the driving transistor in response to the jth scan signal SCAN(j). The jth scan signal SCAN(j) is supplied to the subpixel SP through the jth scan line SCANL(j). The kth data voltage is a voltage to be synchronized with the jth scan signal SCAN(j). The first transistor T1 includes the gate connected to the jth scan line SCANL(j), a first electrode connected to the kth data line DLk, and a second electrode connected to the source node DTS of the driving transistor.

The second transistor T2 is a switching element configured to diode-connect the driving transistor DT by electrically connecting a current path between the gate and the drain of the driving transistor DT in response to the jth scan signal SCAN(j). If the driving transistor DT is diode-connected, a potential of the gate and the drain of the driving transistor DT is "Vdata−|Vth|". Therefore, if the driving transistor DT is diode-connected, the threshold voltage Vth of the driving transistor DT is sampled. The second transistor T2 includes the gate connected to the jth scan line SCANL(j), a first electrode connected to the drain node DTD of the driving transistor, and a second electrode connected to the gate node DTG of the driving transistor.

The third transistor T3 is a switching element configured to supply the variable voltage VV2 to the source node DTS of the driving transistor in response to the jth emission control signal EM(j). The jth emission control signal EM(j) is supplied to the subpixel through the jth emission control signal line EML(j). The third transistor T3 includes the gate connected to the jth emission control signal line EML(j), a first electrode connected to the source node DTS of the driving transistor, and a second electrode connected to a variable voltage line VVL2 to which the variable voltage VV2 is applied.

The capacitor Cst is connected between the second electrode of the third transistor T3 and the gate node DTG of the driving transistor.

The fourth transistor T4 is a switching element configured to enable a driving current generated in the driving transistor DT to be applied to the anode of the electroluminescent element EL by electrically connecting a current path between the drain of the driving transistor DT and the anode of the electroluminescent element EL in response to the jth emission control signal EM(j). The fourth transistor T4 includes the gate connected to the jth emission control signal line EML(j), a first electrode connected to the drain node DTD of the driving transistor, and a second electrode connected to the anode of the electroluminescent element EL. The fourth transistor T4 blocks a current path between the driving transistor DT and the electroluminescent element EL during the initialization period INI, the sampling period SAM, and the holding period HLD to suppress unwanted emission of the electroluminescent element EL. If the electroluminescent element EL emits light during the other periods except the emission period EMI, the brightness of a black grayscale is increased, and, thus, the contrast ratio may be decreased. The black grayscale has the minimum grayscale value, for example, 00000000(2), in pixel data. The brightness of a pixel at the black grayscale may be the minimum brightness. Therefore, in order to suppress emission of the electroluminescent element EL during the other periods except the emission period EMI, the fourth transistor T4 blocks a current path connected to the electroluminescent element EL during the initialization period INI, the sampling period SAM, and the holding period HLD and connects the current path between the electroluminescent element EL and the driving transistor DT during the emission period EMI in response to the jth emission control signal EM(j).

The fifth transistor T5 is a switching element configured to supply the initialization voltage VINI to the gate node DTG of the driving transistor in response to the j−1th scan signal SCAN(j−1). The fifth transistor T5 includes the gate connected to the j−1th scan line SCANL(j−1), a first electrode connected to the gate node DTG of the driving transistor, and a second electrode connected to the initialization voltage line VINIL to which the initialization voltage VINI is applied.

The sixth transistor T6 is a switching element configured to supply the initialization voltage VINI to the anode of the electroluminescent element EL in response to the jth scan signal SCAN(j). The sixth transistor T6 includes a gate connected to the jth scan line SCANL(j), a first electrode connected to the anode of the electroluminescent element EL, and a second electrode connected to the initialization voltage line VINIL.

In this case, the second and fifth transistors T2 and T5 connected to the gate of the driving transistor DT are turned off for a long time and thus vulnerable to a leakage current. If a leakage current occurs in the second and fifth transistors T2 and T5, a voltage of the gate node DTG of the driving transistor is changed during the emission period EMI. Thus, it is difficult to implement a desired grayscale. Therefore, the second and fifth transistors T2 and T5 may be configured to have a dual-gate structure in order to reduce a leakage current. The dual-gate structure refers to a structure in which two transistors are connected in series and controlled in response to the same gate signal. And, if the second and fifth transistors T2 and T5 are implemented as transistors, for example, oxide transistors, in which a very small leakage current occurs, they may be configured to have a single-gate structure.

Hereinafter, the driving characteristics of the subpixel SP will be described. One frame for driving the subpixel circuit illustrated in FIG. 7 includes the initialization period INI in which the j−1th scan signal SCAN(j−1) is input into the j−1th scan line SCANL(j−1), the sampling period SAM in which the jth scan signal SCAN(j) is input into the jth scan line SCANL(j), the emission period EMI in which the electroluminescent element EL emits light, and the holding period HLD between the sampling period SAM and the emission period EMI.

During the initialization period INI, a voltage of the j−1th scan signal SCAN(j−1) is reversed to a gate-on voltage and the jth emission control signal EM(j) is reversed to a gate-off voltage. During the initialization period INI, the jth scan signal SCAN(j) maintains a gate-off voltage. In this case, the variable voltage line VVL2 is applied with the reference voltage VREF.

As the fifth transistor T5 is turned on in response to the gate-on voltage of the j−1th scan signal SCAN(j−1) in the initialization period INI, the initialization voltage VINI is applied to the gate node DTG of the driving transistor through the fifth transistor T5.

Therefore, during the initialization period INI, the voltage of the gate node DTG of the driving transistor is initialized using the initialization voltage VINI. And, during the initialization period INI, the first to fourth transistors T1 to T4 and the driving transistor DT except the fifth transistor T5 are turned off.

During the sampling period SAM, the voltage of the j−1th scan signal SCAN(j−1) is reversed to a gate-off voltage and a voltage of the jth scan signal SCAN(j) is reversed to a gate-on voltage. During the sampling period SAM, the jth emission control signal EM(j) maintains the gate-off voltage. In this case, the variable voltage line VVL2 is applied with the reference voltage VREF, and, thus, the reference voltage VREF is applied to an electrode on one side of the capacitor Cst. The reference voltage VREF is higher than the initialization voltage VINI and the logic-low voltage VL, and may be in the range of, for example, 3 V to 4 V.

As the first transistor T1 is turned on in response to the gate-on voltage of the jth scan signal SCAN(j) in the sampling period SAM, a data voltage Vdata is applied to the source node DTS of the driving transistor through the first transistor T1.

And, as the second transistor T2 is turned on in response to the gate-on voltage of the jth scan signal SCAN(j), the driving transistor DT is diode-connected. If the driving transistor DT is diode-connected, a potential of the gate and the drain of the driving transistor is "Vdata−|Vth|" due to a current flowing through the driving transistor DT. In this case, if the driving transistor DT is diode-connected, the threshold voltage Vth of the driving transistor DT is sampled and then applied to an electrode on the other side of the capacitor Cst through the gate node DTG of the driving transistor. Therefore, the capacitor Cst is charged with a voltage as much as a difference between the reference voltage VREF and "Vdata−|Vth|".

And, as the sixth transistor T6 is turned on in response to the gate-on voltage of the jth scan signal SCAN(j), the initialization voltage VINI is applied to the anode of the electroluminescent element EL. Therefore, during the sampling period SAM, the anode of the electroluminescent element EL is initialized using the initialization voltage VINI.

During the sampling period SAM, the third to fifth transistors T3 to T5 except the first transistor T1, the second transistor T2, the sixth transistor T6 and the driving transistor DT are turned off.

During the holding period HLD, the voltage of the jth scan signal SCAN(j) is reversed to a gate-off voltage. During the holding period HLD, the j−1th scan signal SCAN(j−1) and the jth emission control signal EM(j) maintain the gate-off voltage. And, the variable voltage line VVL2 is applied with the high-potential power voltage VDD.

The voltage of the electrode on the other side of the capacitor may be changed due to a coupling generated when a voltage applied to the variable voltage line VVL2 connected to the electrode on one side of the capacitor Cst is changed from the reference voltage VREF to the high-potential power voltage VDD during the holding period HLD. Therefore, during the holding period HLD, the voltage of the electrode on the other side of the capacitor Cst is "Vdata−|Vth|+VDD−VREF". The changed voltage of the electrode on the other side of the capacitor Cst is applied to the gate node DTG of the driving transistor. And, during the holding period HLD, the driving transistor DT is also turned off due to an increase in voltage of the gate node DTG of the driving transistor. And, the first to sixth transistors T1 to T6 maintain the turn-off state.

During the emission period EMI, the voltage of the jth emission control signal EM(j) is reversed to a gate-on voltage. During the emission period EMI, the j−1th scan signal SCAN(j−1) and the jth scan signal SCAN(j) maintain the gate-off voltage. In this case, the variable voltage line VVL2 is applied with the high-potential power voltage VDD.

As the third transistor T3 is turned on in response to the gate-on voltage of the jth emission control signal EM(j) in the emission period EMI, the variable voltage VV2 is applied to the source node DTS of the driving transistor through the third transistor T3. Therefore, the voltage of the source node DTS of the driving transistor is changed from "Vdata" to the variable voltage VV2, and, thus, the driving transistor DT is turned on. In this case, the variable voltage VV2 is the high-potential power voltage VDD.

And, the fourth transistor T4 is turned on in response to the gate-on voltage of the jth emission control signal EM(j), the fourth transistor T4 electrically connects the drain node DTD of the driving transistor and the anode of the electroluminescent element EL.

During the emission period EMI, the gate node DTG of the driving transistor has a voltage of "Vdata−|Vth|+VDD−VREF" and the source of the driving transistor DT has the high-potential power voltage VDD. Accordingly, the voltage Vsg between the source and the gate of the driving transistor DT that determines a driving current of the electroluminescent element EL is set. A driving current Ie1 as represented by the following Equation 2 flows through the electroluminescent element EL.

$$Ie1=K(Vsg-|Vth|)^2=K\{\mathrm{VDD}-[V\mathrm{data}-|Vth|+\mathrm{VDD}-V\mathrm{REF}]-|Vth|\}^2=K(V\mathrm{data}-V\mathrm{REF})^2 \quad \text{[Equation 2]}$$

Herein, K represents a constant value which is determined by the mobility, channel ratio and parasitic capacitance of the driving transistor DT and Vth represents a threshold voltage of the driving transistor DT.

As can be seen from Equation 2, a current of the electroluminescent element EL of the present disclosure is not affected by the high-potential power voltage VDD. In the embodiments of the present disclosure, the variable voltage VV2 which can be changed to the reference voltage VREF and the high-potential power voltage VDD is applied to the subpixel SP. Therefore, the driving current Ie1 of the electroluminescent element EL is not affected by the high-potential power voltage VDD. Thus, a uniform image quality can be implemented in a high-resolution panel and a large-size panel with improved brightness and image quality can be provided.

And, the anode of the electroluminescent element EL can be initialized using the initialization voltage VINI during the initialization period INI. And, a decrease in contrast ratio of the electroluminescent display device can be suppressed using the reference voltage VREF which is a sufficiently high voltage to express a black grayscale of low brightness during the sampling period SAM. In this case, the sufficiently high voltage refers to a voltage which can generate a driving current for expressing a black grayscale in the high-resolution display panel.

Hereinafter, a configuration of the gate driver configured to apply the variable voltage VV2 which can be changed to the initialization voltage VINI and the reference voltage VREF to the subpixel SP will be described.

Figure 8:
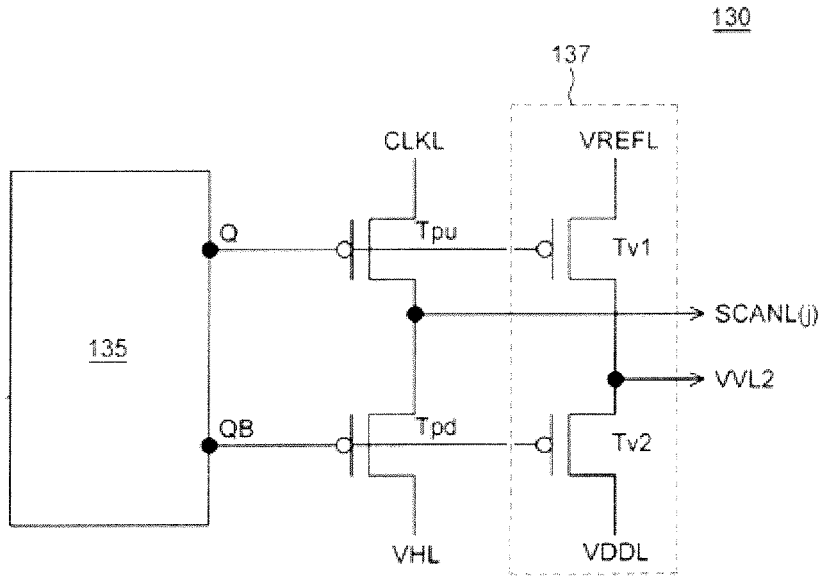
FIG. 8 is a diagram illustrating a configuration of a gate driver according to the second embodiment of the present disclosure.

FIG. 8 is a diagram illustrating a configuration of a gate driver according to the second embodiment of the present disclosure.

Referring to FIG. 8, the gate driver 130 includes the pull-up transistor Tpu whose gate is connected to the Q node Q, the pull-down transistor Tpd whose gate is connected to the QB node QB, the node controller 135 configured to control voltages of the Q node Q and the QB node QB, and the variable voltage output unit 137.

The node controller 135 may include transistors configured to charge or discharge the Q node Q and the QB node QB with voltages having phases opposite to each other.

The Q node Q and the QB node QB are charged or discharged opposite to each other. For example, if the logic-high voltage VH is applied to the Q node Q, the logic-low voltage VL is applied to the QB node QB. If the logic-low voltage VL is applied to the Q node Q, the logic-high voltage VH is applied to the QB node QB. In this case, the pull-up transistor Tpu and the pull-down transistor Tpd are turned on/turned off, and, thus, the gate-on voltage or the gate-off voltage can be supplied to the subpixel SP.

The gate of the pull-up transistor Tpu is connected to the Q node Q, the first electrode is connected to the clock signal line CLKL to which a clock signal is applied, and a second electrode is connected to the jth scan line SCANL(j) to which the jth scan signal SCAN(j) is output. When the logic-low voltage VL is applied to the Q node Q, the pull-up transistor Tpu is turned on and outputs a clock signal to the jth scan line SCANL(j). For example, the clock signal swings between the logic-low voltage VL and the logic-high voltage VH with a pulse width of one horizontal period. And, when the Q node Q has the logic-low voltage VL, the clock signal may be the logic-low voltage VL.

The gate of the pull-down transistor Tpd is connected to the QB node QB, a first electrode is connected to the jth scan line SCANL(j) to which the jth scan signal SCAN(j) is output, and a second electrode is connected to the logic-high voltage line VHL to which the logic-high voltage VH is applied. When the logic-low voltage VL is applied to the QB node QB, the pull-down transistor Tpd is turned on and outputs the logic-high voltage VH to the jth scan line SCANL(j).

The variable voltage output unit 137 according to the second embodiment of the present disclosure includes the first variable voltage transistor Tv1 and the second variable voltage transistor Tv2 to output the variable voltage VV2.

The gate of the first variable voltage transistor Tv1 is turned on or off as connected to the Q node Q and synchronized with the pull-up transistor Tpu. The first electrode of the first variable voltage transistor Tv1 is connected to the reference voltage line VREF to which the reference voltage VREF is applied, and the second electrode is connected to the variable voltage line VVL2 to which the variable voltage VV2 is output. When the logic-low voltage VL is applied to the Q node Q, the first variable voltage transistor Tv1 is turned on and outputs the high-potential power voltage VDD to the variable voltage line VVL2.

The gate of the second variable voltage transistor Tv2 is turned on or off as connected to the QB node QB and synchronized with the pull-down transistor Tpd. The first electrode of the second variable voltage transistor Tv2 is connected to the variable voltage line VVL2 to which the variable voltage VV2 is output, and the second electrode is connected to the high-potential power voltage line VDDL to which the high-potential power voltage VDD is applied. When the logic-low voltage VL is applied to the QB node QB, the second variable voltage transistor Tv2 is turned on and outputs the high-potential power voltage VDD to the variable voltage line VVL2.

The gate driver according to the second embodiment of the present disclosure includes the variable voltage output unit 137 which can selectively output the high-potential power voltage VDD and the reference voltage VREF to the variable voltage line VVL2. Thus, the number of power supply lines to be disposed in the subpixel SP can be reduced.

Figure 9:
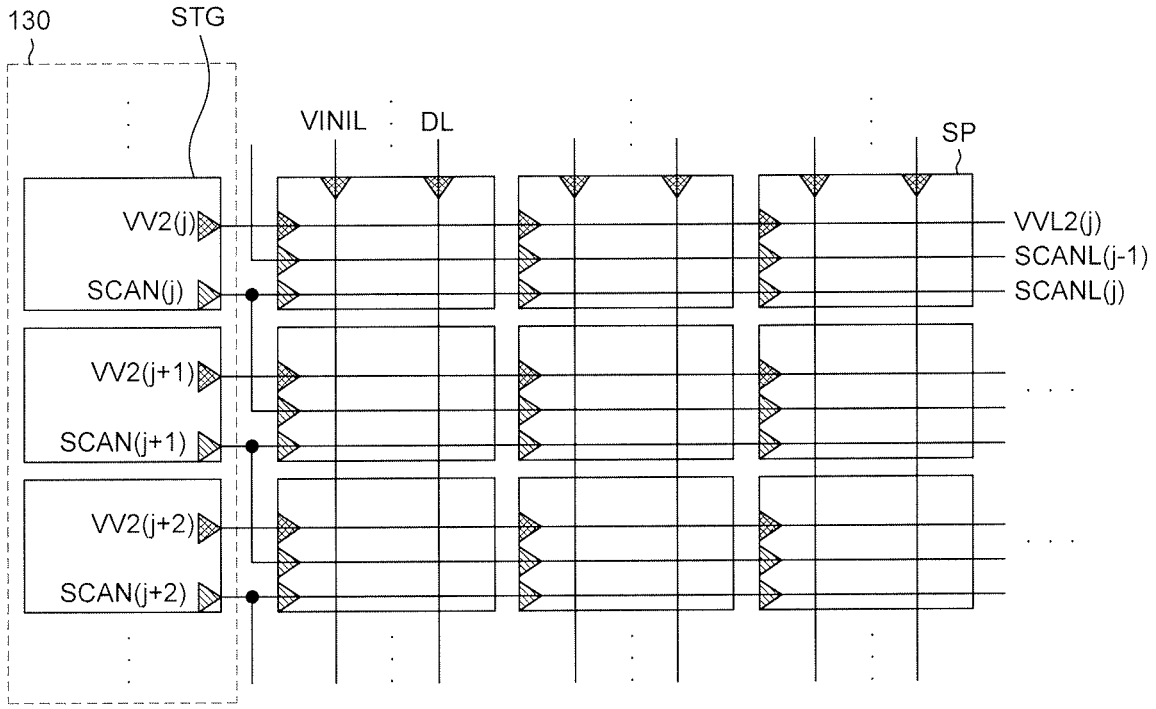
FIG. 9 is a block diagram illustrating a gate driver and a subpixel according to an embodiment of the present disclosure.

FIG. 9 is a block diagram illustrating a gate driver and a subpixel according to an embodiment of the present disclosure. In detail, the subpixel SP according to the second embodiment of the present disclosure as illustrated in FIG. 6 and the gate driver illustrated in FIG. 8 are applied to FIG. 9.

The gate driver 130 includes a plurality of stages STG. FIG. 9 illustrates jth, j+1th and j+2 stages STG for an explanation. Each of the plurality of stages STG may include the circuit illustrated in FIG. 8. In this case, each of the plurality of stages STG is connected to the variable voltage line VVL2 and the scan signal line SCANL and supplies the variable voltage VV2 and the scan signal SCAN to the subpixel SP.

As described above, the variable voltage output unit 137 included in the gate driver 130 outputs the high-potential power voltage VDD or the reference voltage VREF to the variable voltage line VVL2. Thus, a separate high-potential power voltage line VDDL or reference voltage line VREFL may be omitted from each subpixel SP.

Therefore, lines disposed in a vertical direction with respect to each subpixel SP may include only the initialization voltage line VINIL and the data line DL.

The embodiments of the present disclosure can also be described as follows.

According to an aspect of the present disclosure, an electroluminescent display device includes a display panel including a display area in which an image is displayed and a non-display area in which an image is not displayed. The electroluminescent display device further includes a subpixel including a subpixel circuit disposed in the display area and an electroluminescent element, wherein the subpixel circuit includes a driving transistor. The electroluminescent display device also includes a gate driver in the non-display area, and a variable voltage output unit in the non-display area and configured to supply a variable voltage to the subpixel. The variable voltage output unit selectively outputs an initialization voltage or a reference voltage to an anode of the electroluminescent element. Therefore, the anode of the electroluminescent element can be initialized using the initialization voltage during an initialization period. Further, a decrease in contrast ratio of the electroluminescent display device can be suppressed using the reference voltage which is a sufficiently high voltage to express a black grayscale of low brightness during a sampling period.

The subpixel circuit may include a capacitor connected to a gate of the driving transistor, and the variable voltage output unit may output the variable voltage in order to apply the variable voltage to an electrode on one side or an electrode on the other side of the capacitor.

The variable voltage output unit may output the initialization voltage during an initialization period for initializing the anode of the electroluminescent element. The variable voltage output unit may output the reference voltage during a sampling period for sampling a threshold voltage of the driving transistor.

The variable voltage output unit may include a first variable voltage transistor and a second variable voltage transistor. The first variable voltage transistor may be turned on to output the initialization voltage to a variable voltage line to which the variable voltage is applied. The second variable voltage transistor may be turned on to output the reference voltage to the variable voltage line.

The gate driver may include a pull-up transistor and a pull-down transistor. The pull-up transistor and the first variable voltage transistor may be turned on and off as synchronized with each other. The pull-down transistor and the second variable voltage transistor may be turned on and off as synchronized with each other.

The display panel may include an nth pixel line and an mth data line (n and m are natural numbers of 1 or more) and the subpixel may be disposed on a jth ($1 \le j \le n$, j is a natural number) pixel line and may emit light with brightness corresponding to a kth ($1 \le k \le m$, k is a natural number) data voltage. The subpixel may include a first transistor of which a gate is connected to a jth scan line and a first electrode is connected to a kth data line, a second transistor of which a gate is connected to the jth scan line, a first electrode is connected to a drain of the driving transistor, and a second electrode is connected to a gate of the driving transistor, a driving transistor of which a gate is connected to a gate node, a first electrode is connected to a high-potential power voltage line, and a drain is connected to the first electrode of the second transistor, a capacitor of which an electrode on one side is connected to the gate node of the driving transistor and an electrode on the other side is connected to a second electrode of the first transistor, a third transistor of which a gate is connected to a jth emission control signal line, a first electrode is connected to the electrode on the other side of the capacitor, and a second electrode is connected to a variable voltage line to which the variable voltage is applied, a fourth transistor of which a gate is connected to the jth emission control signal line, a first electrode is connected to the drain of the driving transistor, and a second electrode is connected to the anode of the electroluminescent element, a fifth transistor of which a gate is connected to a j−1th scan line, a first electrode is connected to the second electrode of the fourth transistor, and a second electrode is connected to the variable voltage line, a sixth transistor of which a gate is connected to the j−1th scan line, a first electrode is connected to the gate node of the driving transistor, and a second electrode is connected to the variable voltage line; and a seventh transistor of which a gate is connected to the j−1th scan line, a first electrode is connected to the high-potential power voltage line, and a second electrode is connected to the electrode on the other side of the capacitor.

According to another aspect of the present disclosure, an electroluminescent display device includes a display panel including a display area in which an image is displayed and a non-display area in which an image is not displayed. The electroluminescent display device further includes a subpixel including a subpixel circuit disposed in the display area and an electroluminescent element, wherein the subpixel circuit includes a driving transistor and a capacitor connected to a gate of the driving transistor. The electroluminescent display device also includes a gate driver disposed in the non-display area, and a variable voltage output unit disposed in the non-display area and configured to supply a variable voltage to the subpixel. The variable voltage output unit selectively outputs a high-potential power voltage or a reference voltage to a source of the driving transistor and an electrode on one side of the capacitor. Therefore, a driving current of the electroluminescent element is not affected by the high-potential power voltage. Thus, a uniform image quality can be implemented in a high-resolution panel to provide a large-size panel with improved brightness and image quality. Also, a decrease in contrast ratio of the electroluminescent display device can be suppressed.

The variable voltage output unit may output the high-potential power voltage during an initialization period for initializing the gate of the driving transistor and a sampling period for sampling a threshold voltage of the driving transistor. The variable voltage output unit may output the reference voltage during a holding period and an emission period subsequent to the sampling period.

The variable voltage output unit may include a first variable voltage transistor and a second variable voltage transistor. The first variable voltage transistor may be turned on to output the high-potential power voltage to a variable voltage line to which the variable voltage is applied. The second variable voltage transistor may be turned on to output the reference voltage to the variable voltage line.

The gate driver may include a pull-up transistor and a pull-down transistor. The pull-up transistor and the first variable voltage transistor may be turned on and off as synchronized with each other. The pull-down transistor and the second variable voltage transistor may be turned on and off as synchronized with each other.

The display panel may include an nth pixel line and an mth data line (n and m are natural numbers of 1 or more) and the subpixel may be disposed on a jth ($1 \leq j \leq n$, j is a natural number) pixel line and may emit light with brightness corresponding to a kth ($1 \leq k \leq m$, k is a natural number) data voltage. The subpixel may include a driving transistor of which a gate is connected to a gate node, a source is connected to a source node, and a drain is connected to a drain node, a first transistor of which a gate is connected to a jth scan line, a first electrode is connected to a kth data line, and a second electrode is connected to the source node, a second transistor of which a gate is connected to the jth scan line, a first electrode is connected to the drain node, and a second electrode is connected to the gate node, a capacitor of which an electrode on one side is connected to the gate node and an electrode on the other side is connected to a variable voltage line to which the variable voltage is applied, a third transistor of which a gate is connected to a jth emission control signal line, a first electrode is connected to the source node, and a second electrode is connected to the variable voltage line, a fourth transistor of which a gate is connected to the jth emission control signal line, a first electrode is connected to the drain node, and a second electrode is connected to the anode of the electroluminescent element, a fifth transistor of which a gate is connected to a j−1th scan line, a first electrode is connected to the electrode on the other side of the capacitor, and a second electrode is connected to an initialization voltage line to which an initialization voltage is applied, and a sixth transistor of which a gate is connected to the jth scan line, a first electrode is connected to the second electrode of the fourth transistor, and a second electrode is connected to the initialization voltage line.

According to yet another aspect of the present disclosure, there is provided a gate driver configured to output a scan signal to a subpixel for displaying an image. The gate driver includes a pull-up transistor turned on or off by a voltage of a Q node and a pull-down transistor turned on or off by a voltage of a QB node. The gate driver further includes a node controller configured to control the voltages of the Q node and the QB node and a variable voltage output unit configured to selectively output any one of an initialization voltage, a high-potential power voltage, and a reference voltage depending on a driving period of the subpixel. Therefore, the number of power supply lines to be disposed in the subpixel can be reduced.

The variable voltage output unit may include a first variable voltage transistor and a second variable voltage transistor. A gate of the first variable voltage transistor may be connected to the Q node. A gate of the second variable voltage transistor may be connected to the QB node.

A first electrode of the first variable voltage transistor may be connected to an initialization voltage line or a high-potential power voltage line to which the initialization voltage or the high-potential power voltage is applied, respectively. A first electrode of the second variable voltage transistor may be connected to a reference voltage line to which the reference voltage is applied.

The subpixel circuit may include a capacitor connected to a gate of the driving transistor. The variable voltage output unit may output the variable voltage in order to apply the variable voltage to an electrode on one side or an electrode on the other side of the capacitor.

The variable voltage output unit may output the initialization voltage during an initialization period for initializing the anode of the electroluminescent element. The variable voltage output unit may output the reference voltage during a sampling period for sampling a threshold voltage of the driving transistor.

The variable voltage output unit may include a first variable voltage transistor and a second variable voltage transistor. The first variable voltage transistor may be turned on to output the initialization voltage to a variable voltage line to which the variable voltage is applied. The second variable voltage transistor may be turned on to output the reference voltage to the variable voltage line.

The gate driver may include a pull-up transistor and a pull-down transistor. The pull-up transistor and the first variable voltage transistor may be turned on and off as synchronized with each other. The pull-down transistor and the second variable voltage transistor may be turned on and off as synchronized with each other. The term synchronized may refer to a time-synchronization of the switching time of these transistors. So, the pull-up transistor and the first variable voltage transistor may be switched simultaneously. So, the pull-down transistor and the second variable voltage transistor may be switched simultaneously.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical gist of the present disclosure. The scope of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. An electroluminescent display device, comprising:

a display panel including a display area in which an image is displayed and a non-display area in which an image is not displayed;

a subpixel including a subpixel circuit and an electroluminescent element, wherein the subpixel circuit includes a driving transistor in the display area;

a gate driver in the non-display area; and a variable voltage output unit in the display panel and supplying a variable voltage to the subpixel, wherein the variable voltage output unit selectively outputs an initialization voltage or a reference voltage to an anode of the electroluminescent element, wherein the variable voltage output unit outputs the initialization voltage during an initialization period for initializing the anode of the electroluminescent element, and the variable voltage output unit outputs the reference voltage during a sampling period for sampling a threshold voltage of the driving transistor.

2. The electroluminescent display device according to claim 1, wherein the subpixel circuit includes a capacitor connected to a gate of the driving transistor, and the variable voltage output unit outputs the variable voltage in order to apply the variable voltage to an electrode on one side of the capacitor or to an electrode on the other side of the capacitor.

3. The electroluminescent display device according to claim 1, wherein the variable voltage output unit includes a first variable voltage transistor and a second variable voltage transistor, the first variable voltage transistor is turned on to output the initialization voltage to a variable voltage line to which the variable voltage is applied, and the second variable voltage transistor is turned on to output the reference voltage to the variable voltage line.

4. The electroluminescent display device according to claim 3, wherein the gate driver includes a pull-up transistor and a pull-down transistor, and the pull-up transistor and the first variable voltage transistor are turned on and off as synchronized with each other, and the pull-down transistor and the second variable voltage transistor are turned on and off as synchronized with each other.

5. The electroluminescent display device according to claim 1, wherein the display panel includes an nth pixel line and an mth data line, where n and m are natural numbers of 1 or more, the subpixel is on a jth pixel line and emits light with brightness corresponding to a kth data voltage, where $1 \leq j \leq n$, j is a natural number, $1 \leq k \leq m$, and k is a natural number, and the subpixel includes:

a first transistor of which a gate is connected to a jth scan line and a first electrode is connected to a kth data line;

a second transistor of which a gate is connected to the jth scan line, a first electrode is connected to a drain of the driving transistor, and a second electrode is connected to a gate of the driving transistor;

a driving transistor of which a gate is connected to a gate node, a first electrode is connected to a high-potential power voltage line, and a drain is connected to the first electrode of the second transistor;

a capacitor of which an electrode on one side is connected to the gate node of the driving transistor and an electrode on the other side is connected to a second electrode of the first transistor;

a third transistor of which a gate is connected to a jth emission control signal line, a first electrode is connected to the electrode on the other side of the capacitor, and a second electrode is connected to a variable voltage line to which the variable voltage is applied;

a fourth transistor of which a gate is connected to the jth emission control signal line, a first electrode is connected to the drain of the driving transistor, and a second electrode is connected to the anode of the electroluminescent element;

a fifth transistor of which a gate is connected to a j−1th scan line, a first electrode is connected to the second electrode of the fourth transistor, and a second electrode is connected to the variable voltage line;

a sixth transistor of which a gate is connected to the j−1th scan line, a first electrode is connected to the gate node of the driving transistor, and a second electrode is connected to the variable voltage line; and a seventh transistor of which a gate is connected to the j−1th scan line, a first electrode is connected to the high-potential power voltage line, and a second electrode is connected to the electrode on the other side of the capacitor.

6. An electroluminescent display device, comprising:

a display panel including a display area in which an image is displayed and a non-display area in which an image is not displayed;

a subpixel including a subpixel circuit and an electroluminescent element, wherein the subpixel circuit includes a driving transistor and a capacitor connected to a gate of the driving transistor in the display area, a gate driver in the non-display area; and a variable voltage output unit in the display panel and supplying a variable voltage to the subpixel, wherein the variable voltage output unit selectively outputs a high-potential power voltage or a reference voltage to a source of the driving transistor and an electrode on one side of the capacitor, wherein the variable voltage output unit outputs the reference voltage during an initialization period for initializing the gate of the driving transistor and a sampling period for sampling a threshold voltage of the driving transistor, and the variable voltage output unit outputs the high-potential power voltage during a holding period and an emission period subsequent to the sampling period.

7. The electroluminescent display device according to claim 6, wherein the variable voltage output unit includes a first variable voltage transistor and a second variable voltage transistor, the first variable voltage transistor is turned on to output the reference voltage to a variable voltage line to which the variable voltage is applied, and the second variable voltage transistor is turned on to output the high-potential power voltage to the variable voltage line.

8. The electroluminescent display device according to claim 7, wherein the gate driver includes a pull-up transistor and a pull-down transistor, and the pull-up transistor and the first variable voltage transistor are turned on and off as synchronized with each other, and the pull-down transistor and the second variable voltage transistor are turned on and off as synchronized with each other.

9. The electroluminescent display device according to claim 6, wherein the display panel includes an nth pixel line and an mth data line, where n and m are natural numbers of 1 or more, the subpixel is on a jth pixel line and emits light with brightness corresponding to a kth data voltage, where $1 \leq j \leq n$, j is a natural number, $1 \leq k \leq m$, and k is a natural number, and the subpixel includes:

a driving transistor of which a gate is connected to a gate node, a source is connected to the source node, and a drain is connected to a drain node;

a first transistor of which a gate is connected to a jth scan line, a first electrode is connected to a kth data line, and a second electrode is connected to the source node;

a second transistor of which a gate is connected to the jth scan line, a first electrode is connected to the drain node, and a second electrode is connected to the gate node;

a capacitor of which an electrode on one side is connected to the gate node and an electrode on the other side is connected to a variable voltage line to which the variable voltage is applied;

a third transistor of which a gate is connected to a jth emission control signal line, a first electrode is connected to the source node, and a second electrode is connected to the variable voltage line;

a fourth transistor of which a gate is connected to a gate of the jth emission control signal line, a first electrode is connected to the drain node, and a second electrode is connected to the anode of the electroluminescent element;

a fifth transistor of which a gate is connected to a j−1th scan line, a first electrode is connected to the electrode on the other side of the capacitor, and a second electrode is connected to an initialization voltage line to which an initialization voltage is applied; and a sixth transistor of which a gate is connected to the jth scan line, a first electrode is connected to the second electrode of the fourth transistor, and a second electrode is connected to the initialization voltage line.

10. A gate driver outputting a scan signal to a subpixel for displaying an image, the gate driver comprising:

a pull-up transistor turned on or off by a voltage of a Q node;

a pull-down transistor turned on or off by a voltage of a QB node;

a node controller controlling the voltages of the Q node and the QB node; and a variable voltage output unit selectively outputting any one of an initialization voltage, a high-potential power voltage, and a reference voltage depending on a driving period of the subpixel, wherein the variable voltage output unit includes a first variable voltage transistor and a second variable voltage transistor, a gate of the first variable voltage transistor is connected to the Q node, and a gate of the second variable voltage transistor is connected to the QB node.

11. The gate driver according to claim 10, wherein a first electrode of the first variable voltage transistor is connected to an initialization voltage line or a reference voltage line to which the initialization voltage or the reference voltage is applied, respectively, and a first electrode of the second variable voltage transistor is connected to a reference voltage line or a high-potential power voltage line to which the reference voltage or the high-potential power voltage is applied, respectively.

* * * * *